US005128690A

United States Patent [19]

Nozawa

[11] Patent Number: 5,128,690

[45] Date of Patent: Jul. 7, 1992

[54] RECOVERY UNIT AND METHOD THAT EXPEL FOREIGN MATTER INTO A COMMON LIQUID CHAMBER OF AN INK JET HEAD USING A PARTIAL CAP

[75] Inventor: Minoru Nozawa, Atsugi, Japan

[73] Assignee: Canon Kabushiki Kaisha, Tokyo, Japan

[21] Appl. No.: 463,309

[22] Filed: Jan. 10, 1990

[30] Foreign Application Priority Data

Jan. 11, 1989 [JP] Japan ..... 1-2889

[51] Int. Cl.[5] ..... B41J 2/165

[52] U.S. Cl. ..... 346/1.1; 346/140 R

[58] Field of Search ..... 346/140

[56] References Cited

U.S. PATENT DOCUMENTS 4,313,124 1/1982 Hara .
4,345,262 8/1982 Shirato et al. .
4,459,600 7/1984 Sato et al. .
4,463,359 7/1984 Ayata et al.
4,492,969 1/1985 Terasawa .
4,493,993 1/1985 Kanamuller et al. .
4,557,203 3/1986 Kawamura .
4,558,333 12/1985 Sugitani et al. .
4,559,543 12/1985 Toganoh ..... 346/140
4,723,129 2/1988 Endo et al. .
4,740,796 4/1988 Endo et al. .
4,908,636 3/1990 Saito et al. ..... 346/140
4,947,191 8/1990 Nozawa ..... 346/140
4,970,534 11/1990 Terasawa et al. .

FOREIGN PATENT DOCUMENTS 57-117964 7/1982 Japan .
59-123670 7/1984 Japan .
59-138461 8/1984 Japan .

*Primary Examiner*—Joseph W. Hartary
*Attorney, Agent, or Firm*—Fitzpatrick, Cella, Harper & Scinto

[57] ABSTRACT

An ink jet apparatus comprises an ink jet head having plural discharge openings for discharging ink and plural liquid channels communicating with respective discharge openings. A partial cap member, which can cover at least one of the discharge openings, is connected to a pressure source that can supply sufficient pressure through the covered discharge openings to force any foreign matter in the corresponding liquid channels into a common liquid chamber communicating with all of the channels. A liquid flow can then be created in the common chamber to flush the foreign matter from the ink jet head.

28 Claims, 13 Drawing Sheets

LIQUID FLOW DURING RECOVERY

LIQUID FLOW DURING RECORDING WITH HEAD

LIQUID FLOW DURING RECOVERY

LIQUID FLOW DURING RECORDING WITH HEAD

RECOVERY UNIT AND METHOD THAT EXPEL FOREIGN MATTER INTO A COMMON LIQUID CHAMBER OF AN INK JET HEAD USING A PARTIAL CAP

BACKGROUND OF THE INVENTION

1. Field of the Invention

The present invention relates generally to an ink jet recording apparatus arranged to effect recording by discharging a recording liquid such as ink and, more particularly, to an ink jet recording apparatus provided with means for preventing the failure of ink discharge from occurring due to dust particles clogging in discharge openings (or orifices), excessively condensed ink, bubbles which might be contained in the ink, or the like.

2. Related Background Art

FIG. 1 is a schematic perspective view showing one example of the recording head used in such an ink jet recording apparatus. The illustrated recording head comprises a discharging element 1 including a multiplicity of liquid channels which are arranged side by side at an extremely narrow pitch. As will be explained in detail below, each of the liquid channels includes an energy generator such as a heat-generating device for generating the energy required to discharge a recording liquid (or ink). The discharging element 1 also includes orifices 10 which are formed in the upstream end portions of the respective liquid channels, a common liquid chamber (to be described later) for holding ink to be supplied to the respective liquid channels, and so on. The ink is discharged from each of the orifices 10 to form a recording droplet.

The illustrated recording head further comprises a base plate 3 to which the discharging element 1 is fixed, as by an adhesive, and a front plate 2 fixed to one end face of each of the discharging element 1 and the base plate 3 by means of fastening members such as bolts (not shown). The front plate 2 has an aperture through which the orifices 10 can directly oppose a recording medium (not shown). The recording head also includes elbow-shaped connecting members 15 through which ink is introduced into the common liquid chamber defined in the discharging element 1, filter units 17 disposed midway along individual ink supply paths extending from an ink supply source such as an ink tank, which will be described in connection with FIG. 2, and supply pipes 16 which connect the connecting members 15 with the filter units 17, respectively. These members 15, 16 and 17 form a part of an ink supply system which will be described later.

FIG. 2 is a schematic block diagram showing the discharge failure recovery system used in a typical ink jet recording apparatus. During a normal recording mode, a cap member 4 is held in an appropriate position which does not hinder the recording operation. A valve 31 is kept open, while valves B2 and B3 are kept closed. In this state, ink is supplied from an ink tank 6 to the discharging element 1 through the valve B1 owing to a so-called capillary phenomenon.

When a discharge failure recovery process must be executed, the cap member 4 is moved into contact with the discharging element 1 and the valve B1 is closed, while the valves B2 and B3 are opened. In this state, a pump 7 is activated to feed ink from the ink tank 6 into the ink supply paths by pressure, thereby supplying the pressurized ink to the discharging element 1 and forcing the ink to jet through the orifices 10. Dust particles, excessively condensed ink, bubbles or similar foreign matter which may cause the discharge failure are also expelled from the discharging element 1 together with the jets of ink. For example, as shown in FIG. 4 which will be discussed later, if miniature bubbles a enter some liquid channels 12, they will be expelled from the discharging element 1 through the orifices 10 together with ink jets by the operation of the pump 7. The ink which has jetted from the orifices 10 is received by the cap member 4 and introduced into a waste ink tank 5.

FIGS. 3 and 4 are a vertical sectional view and a horizontal sectional view, respectively, of the recording head of FIG. 1. FIGS. 3 and 4 illustrate the state of the cap member 4 being maintained in contact with the front plate 2 to cover the entire aperture in which the orifices 10 are located.

The liquid channels 12 extend from the respective orifices 10 to an eaves-like end portion 13 which faces the common liquid chamber 14.

The term "ink path" which is used hereinafter is defined as embracing a plurality of liquid channels 12 and the common liquid chamber 14 with which the liquid channels 12 communicate in common.

Each of the liquid channels 12 includes an energy-generating device 11 for generating the energy required to discharge ink, and the energy-generating device 11 utilizes a heat-generating device. (In FIG. 4, only one energy-generating device 11, which is provided in the liquid channel 12 located at one end, is shown for the purpose of illustration.) A filter 100 is disposed in the filter unit 17 in order to eliminate miniature dust particles, bubbles or the like.

However, since the above-described arrangement is designed to effect recovery from a discharge failure by expelling ink through discharge openings (or orifices), no satisfactory result may be obtained in the case of, for example, tapered liquid channels such as those shown in FIG. 4. For instance, it will be impossible to remove dust particles which are larger than the discharging openings.

FIG. 5 is a block diagram showing the fluidic equivalent circuit of a recovery arrangement according to the background art when a discharge failure recovery process is being executed. As can be seen from the figure, during the discharge failure recovery process, the following relationship is established:

$$\Delta p = q \times R1 + n \times q(RH + RC + RF + RS)$$

$$\therefore q = \Delta p / \{r1 + n(RH + RC + RF + RS)\}$$

where $\Delta p$ = pressure, n = number of liquid channels 12, R1 = flow resistance per liquid channel 12, RH = flow resistance of the eaves-like end portion 13, RC = flow resistance of the common liquid chamber 14, RF = flow resistance of the filter units 17, RS = liquid resistance of the portion, excluding the filter units 17, between the ink tank 6 and the common liquid chamber 14, and q = flow rate in each liquid channel 12 when the pressure $\Delta p$ is applied.

It is common practice to design the ink supply system so that R1 > RH + RC + RF + RS can be satisfied. However, if this relationship is applied to, for example, a so-called full multiple type (full line type) of recording head, namely, a recording head of the type having a plurality of liquid channels which are arrayed over a range corresponding to a recording width, the number n of liquid channels 12 increases and the flow rate q per liquid channel 12 decreases to an extremely small extent. If foreign matter such as dust particles or the bubbles a as shown in FIG. 4 enter a particular liquid channel 12, the flow resistance thereof will increase. As a result, the flow rate across the liquid channel in which the discharge failure has occurred is substantially reduced compared to the flow rate across a normal liquid channel. For these reasons, even if any discharge failure is to be eliminated with the discharge failure recovery system according to the background art, it is occasionally impossible to restore a liquid channel which has suffered the discharge failure to a normal state with a recovery operation. There is also a case where the recovery operation must be repeated many times until the discharge failure is recovered.

In addition, to overcome such flow resistance, it is necessary to increase pressure to be applied to the liquid channels and a high-pressure pump must therefore be prepared as the pump 7. As a result, the total amount of ink consumed may increase and it is also required that the strength of the joint portion of each member be increased to a level which can withstand such large pressure.

SUMMARY OF THE INVENTION

It is therefore an object of the present invention to provide a reliable recovery process capable of solving the above-described problems.

It is another object of the present invention to provide an ink jet recording apparatus capable of effecting a highly reliable recovery process without the need for an inexpensive arrangement or an extremely high running cost which has been required for the recovery arrangement explained in connection with the background art because of the necessity of a large recovery system or the high-pressure proof design of each member thereof.

It is another object of the present invention to provide an ink jet apparatus which comprises an ink jet head including a plurality of discharging openings for discharging ink and an ink path communicating with the discharging openings, partial cap means for covering at least one particular discharging opening from among the plurality of discharging openings, and pressure means for supplying pressure through the aforesaid at least one particular discharging opening to the ink path by means of the partial cap means.

It is another object of the present invention to provide a cap unit which comprises partial cap means for covering at least one particular discharging opening from among a plurality of discharging openings formed in an ink jet head, and pressure means for supplying pressure through the aforesaid at least one particular discharging opening to an ink path communicating with this plurality of discharging openings by means of the partial cap means.

It is still another object of the present invention to provide a recovery method for an ink jet head, which comprises the steps of sensing the state of ink being discharged from a plurality of discharging openings formed in the ink jet head, causing partial cap means to cover particular discharging openings which include a discharging opening in which a discharge failure has been detected from among the discharging openings, and supplying pressure through the particular discharging openings to an ink path communicating with the aforesaid plurality of discharging openings by means of the partial cap means.

In the discharge failure recovery process according to the present invention, the pressure means is maintained in contact with the recording head and activated to force gas and/or liquid into the liquid chamber through a ink discharging opening in which a discharge failure has occurred. Then, the ink is expelled from the liquid chamber through appropriate means such as a waste ink reserving member, thereby eliminating foreign matter which has caused the discharge failure.

Further objects, features and advantages of the present invention will become apparent from the following detailed description of embodiments of the present invention with reference to the accompanying drawings.

DESCRIPTION OF THE PREFERRED EMBODIMENTS

Figure 1:
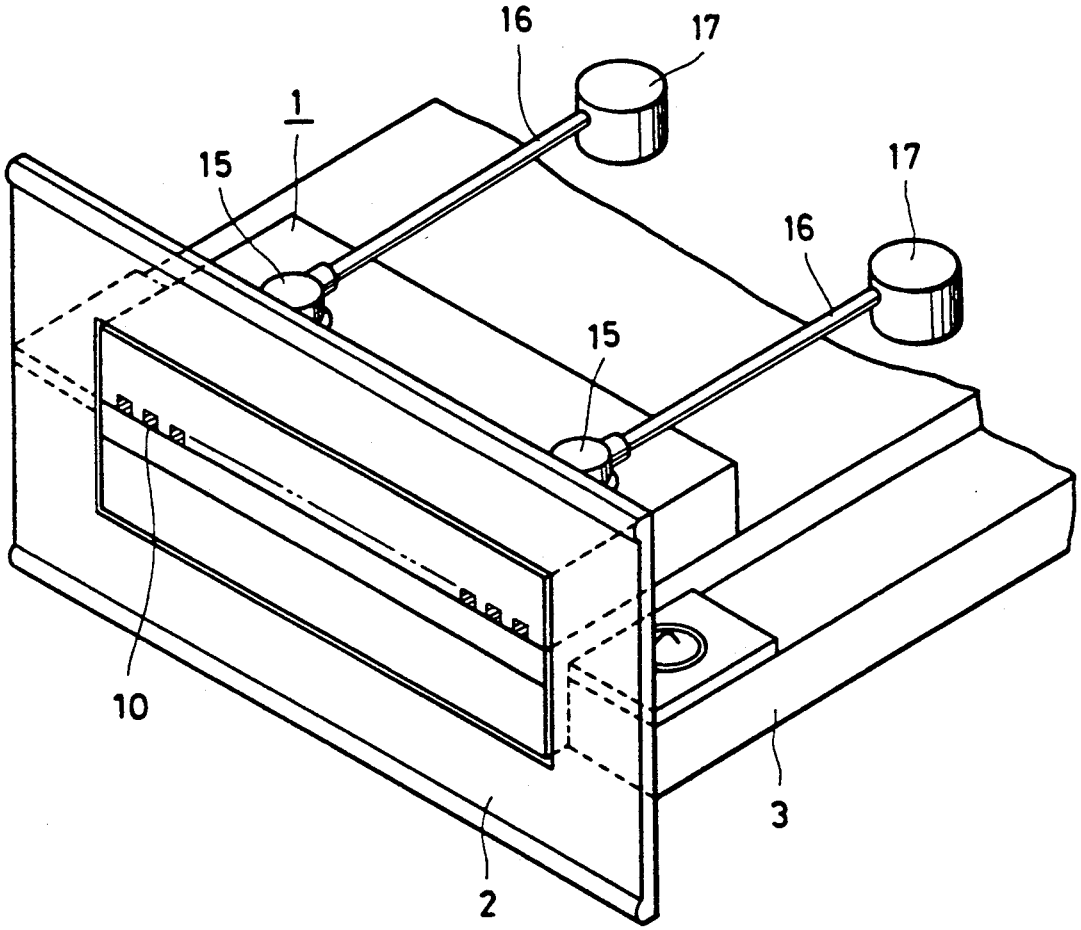
FIG. 1 PRIOR ART
FIG. 1 is a schematic perspective view showing the construction of a recording head according to the background art.
Figure 2:
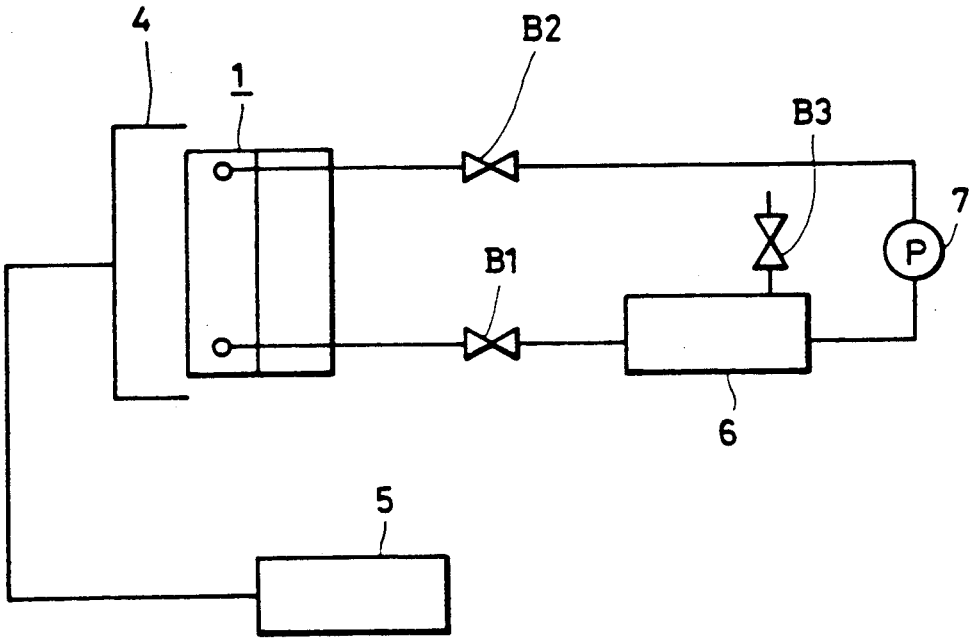
FIG. 2 PRIOR ART
FIG. 2 is a schematic block diagram showing the discharge failure recovery system used in an ink jet recording apparatus according to the background art.
Figure 3:
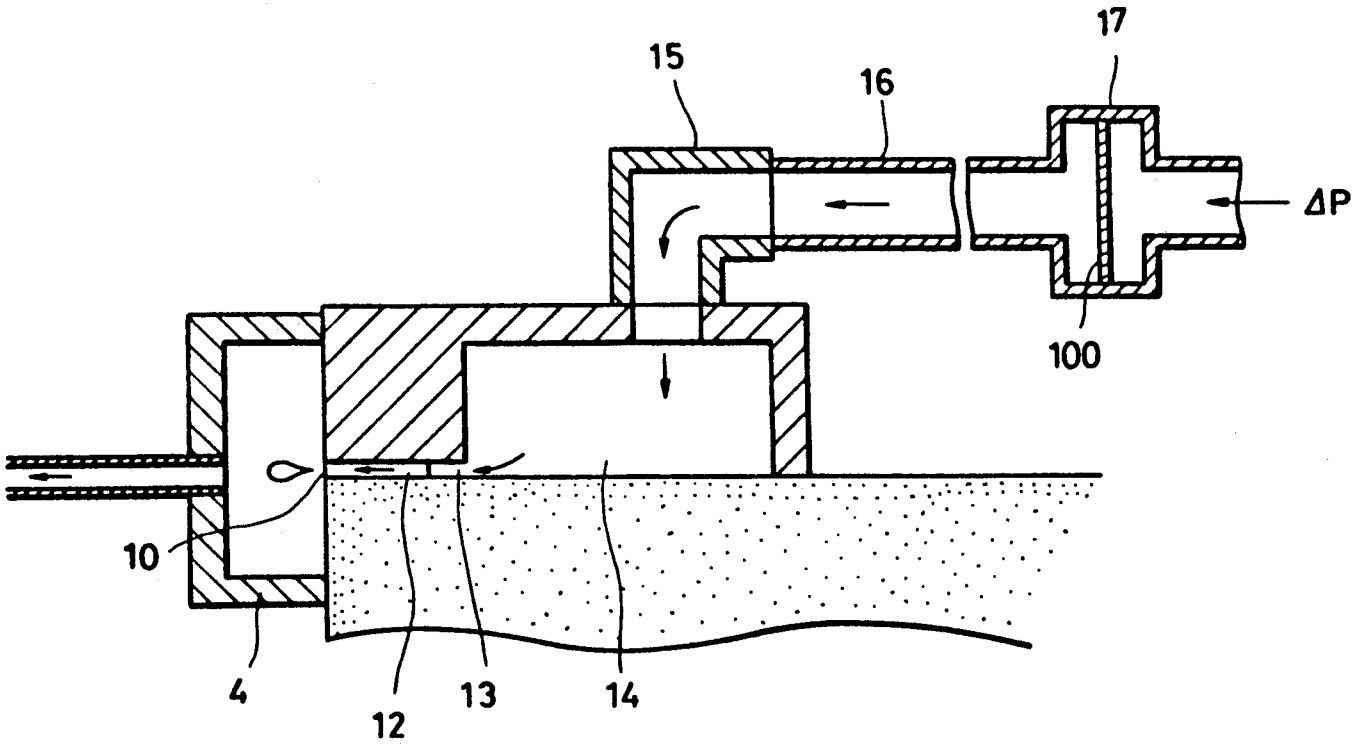
FIG. 3 PRIOR ART
FIG. 3 is a vertical sectional view diagrammatically showing the discharge failure recovery system according to the background art.
Figure 4:
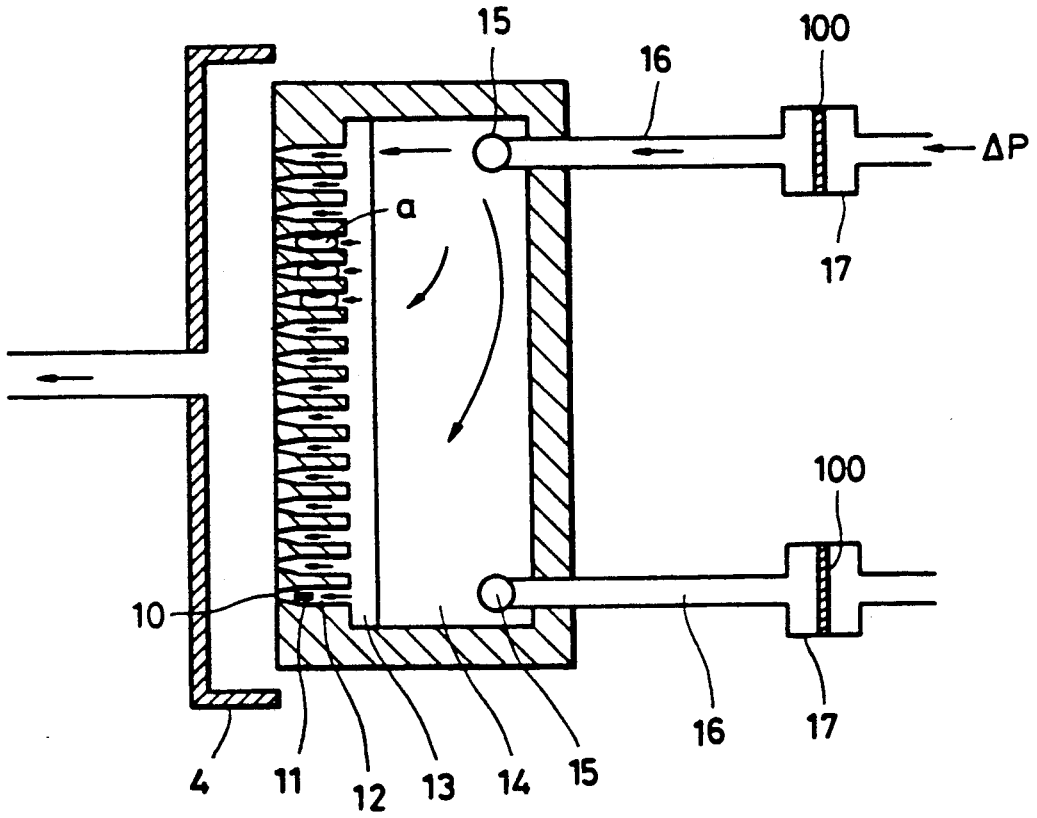
FIG. 4 PRIOR ART
FIG. 4 is a horizontal sectional view diagrammatically showing the discharge failure recovery system of FIG. 3.
Figure 5:
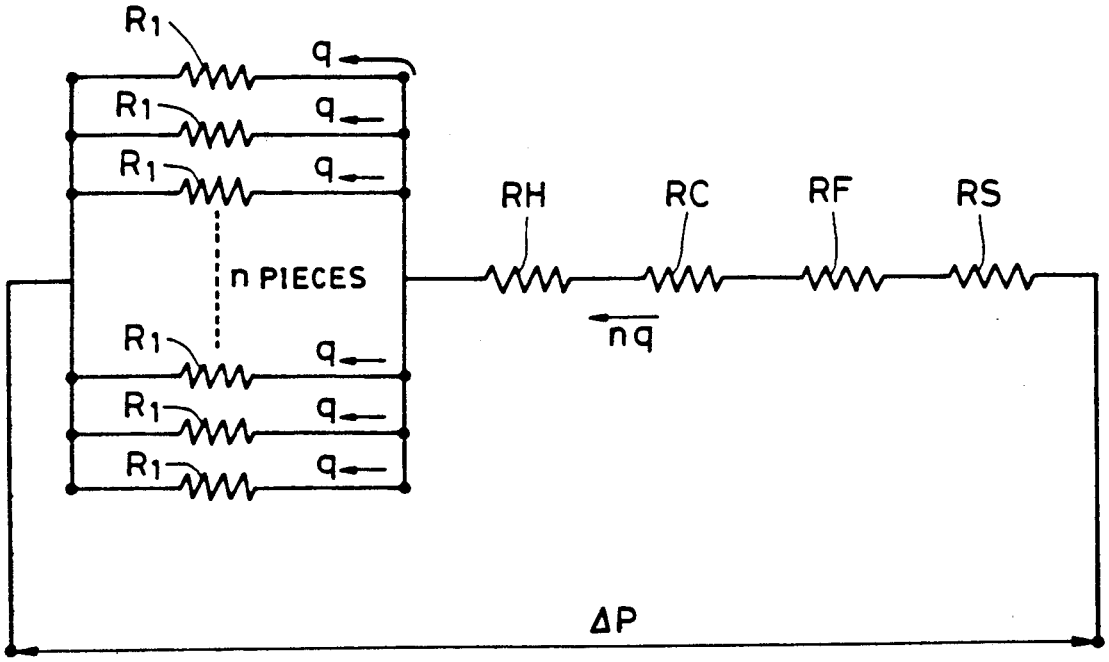
FIG. 5 PRIOR ART
FIG. 5 is an equivalent fluidic circuit showing the discharge failure recovery system according to the background art.

Embodiments of the present invention will be explained below in detail with reference to FIGS. 6 through 11.

In each of the following figures, like reference numerals are used to denote like or corresponding elements which are similar to those explained in connection with the background art, and a description thereof is omitted.

Figure 6:
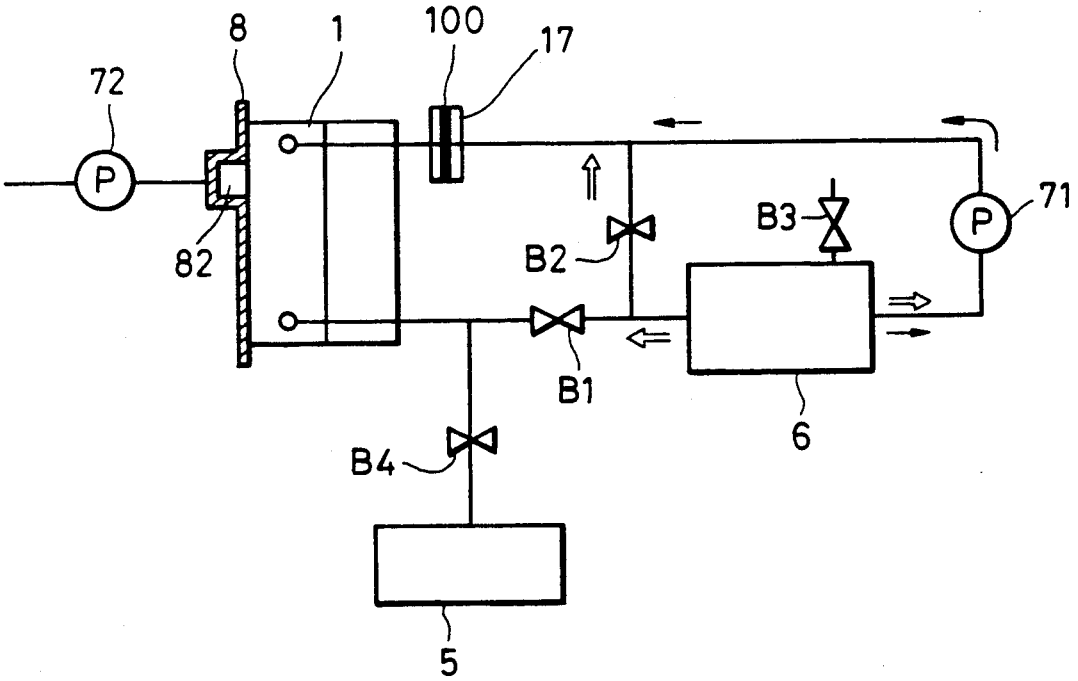
FIG. 6 is a schematic block diagram showing the construction of the essential portion of an ink jet recording apparatus according to one embodiment of the present invention.
Figure 7:
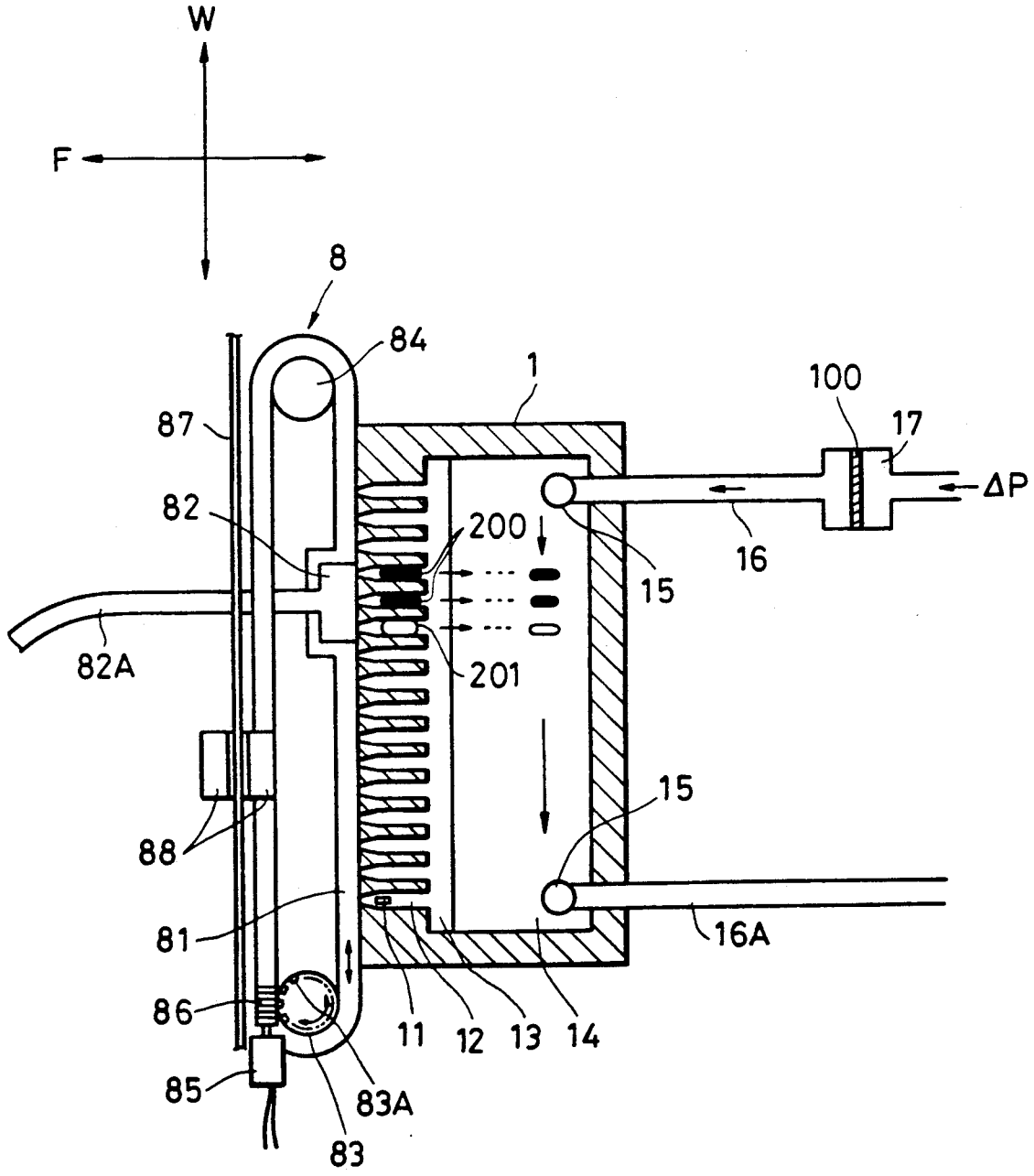
FIG. 7 is a schematic vertical sectional view showing a cap unit maintained in contact with a recording head in the apparatus of FIG. 6.

FIG. 6 is a block diagram schematically showing the construction of a recovery system which constitutes the essential portion of an ink jet recording apparatus according to an embodiment of the present invention. FIG. 7 is a schematic cross-sectional view showing a partial cap 8 maintained in contact with a discharging element 1.

In the recovery system shown in FIG. 6, a partial cap 8 is arranged to keep some orifices open with the others closed. During a discharge failure recovery process, the partial cap 8 is held in a position opposing the illustrated discharging element 1. During a normal recording process, the partial cap 8 is held in a non-opposite position which does not hinder the recording operation. The recovery system also includes an ink tank 6 for holding ink, a first pressure means 71 for pressurizing ink and supplying it to a recording head and for generating an ink flow within a common liquid chamber 14, and a waste ink tank 5. A cap portion 82, which is formed in the partial cap 8, is connected to a second pressure means 72. The recovery system further includes valves B1 to B4 which are arranged to control the ink flow and a filter unit 17 which includes a filter 100.

In the above-described arrangement and construction, if a discharge failure occurs due to dust particles 200, bubbles 201 (refer to FIG. 7) or excessively condensed ink, the cap portion 82 formed in the partial cap 8 is moved to the portion subjected to the discharge failure so that the portion is capped. Then, the second pressure means 72 is activated to apply pressure to each liquid channel subjected to the discharge failure from the side of the corresponding liquid channel, thereby forcing the dust particles 200, the bubbles 201 or the excessively condensed ink—foreign matter which has caused the discharge failure—into the common liquid chamber 14. Then, the first pressure means 71 is, as shown in FIG. 7, activated to cause an ink flow within the common liquid chamber 14, thereby expelling the foreign matter with the ink flow from the common liquid chamber 14.

Referring to FIG. 7, which shows the essential portion of the above-described arrangement, the partial cap 8 is provided with a belt-shaped cap member 81 made of, for example, rubber. The cap member 81 is arranged to be brought into contact with orifices 10 for closing purposes. A part of the cap member 81 is formed into the cap portion 82 for keeping open a predetermined number of orifices. The interior of the cap portion 82 communicates with the second pressure means 72 by a tube 82A. The cap member 81 is passed around a pair of pulleys 83 and 84 so that it can be moved back and forth in the directions indicated by double-headed arrow W of FIG. 7, that is, in the direction in which the orifices 10 are arranged in an array. As illustrated, teeth 83A are formed around the pulley 83.

A worm gear 86 is secured to the output shaft of a motor 85. The worm gears 86 is arranged so that it can engage with the teeth 83A. The rotary motion of the motor 85 is transmitted to the pulley 83 through the worm gear 86 and the teeth 83A so that the cap member 81 is moved back and forth in the directions indicated by double-headed arrow W.

A slit plate 87 is secured in position with respect to the partial cap 8, and photosensors 88 are secured to the cap member 81 so as to detect a slit in the slit plate 87. The position of the cap member 81 which is being moved is detected by utilizing the detection signals output from the photosensors 88.

Figure 8:
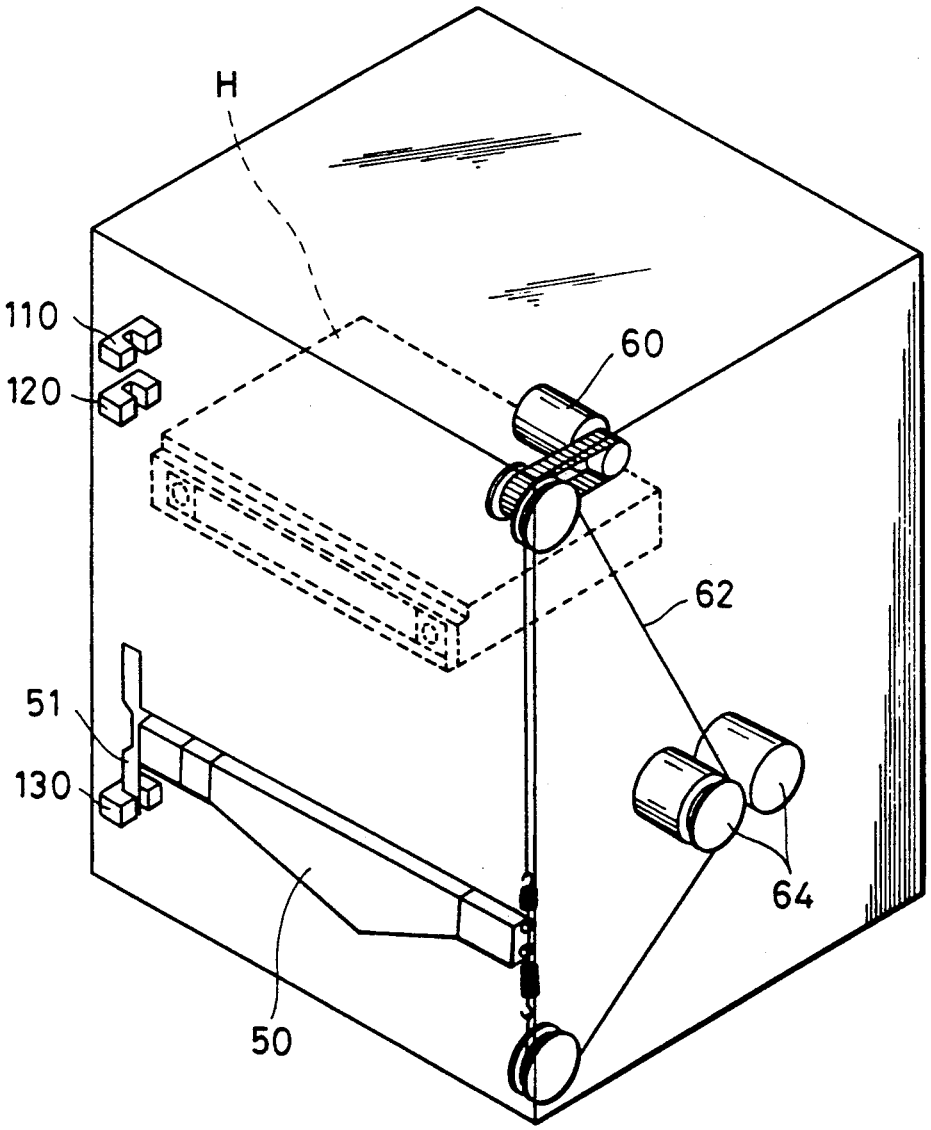
FIG. 8 is a schematic perspective view showing the construction of the ink jet recording apparatus according to the embodiment shown in FIG. 6.

FIG. 8 is a schematic perspective view, with essential inner parts shown, of an ink jet recording apparatus to which the above embodiment of the present invention is applied. A device H, shown by dashed lines, is a recording head of the full line type which includes, for example, a discharging element having a plurality of orifices. Although not shown in FIG. 8, the orifices are arrayed throughout the width of the discharging element which corresponds to the entire width of a recording medium. A cap unit 50 includes the partial cap 8 and a global cap 40 which will be described later in connection with FIG. 9. A wire 62 is connected to a motor unit 60 for moving the cap unit 50 up and down as viewed in FIG. 8, and the cap unit 50 is secured to the wire 62 at an intermediate portion thereof. The cap unit 50 is moved up and down along a guide means (not shown) by the driving of the motor unit 60. Members 64 are provided for adjusting the tension of the wire 62.

Sensors 110 and 120 of, e.g., the photocoupler type are disposed for detecting the upper position of the cap unit 50. The sensors 110 and 120 cooperate to detect whether or not the partial cap 8 or global cap 40 opposes the recording head H. A sensor 130 of a similar photocoupler type is disposed for detecting the lower position of the cap unit 50. The sensor 130 is utilized so that, during recording, the cap unit 50 is set in a position which does not oppose the recording head H and hinder the recording operation. A light shielding plate 51 is disposed on the cap unit 50 at one end thereof to detect the cap unit 50 by intercepting the light path of the sensor 130 of the photocoupler type.

Figure 9:
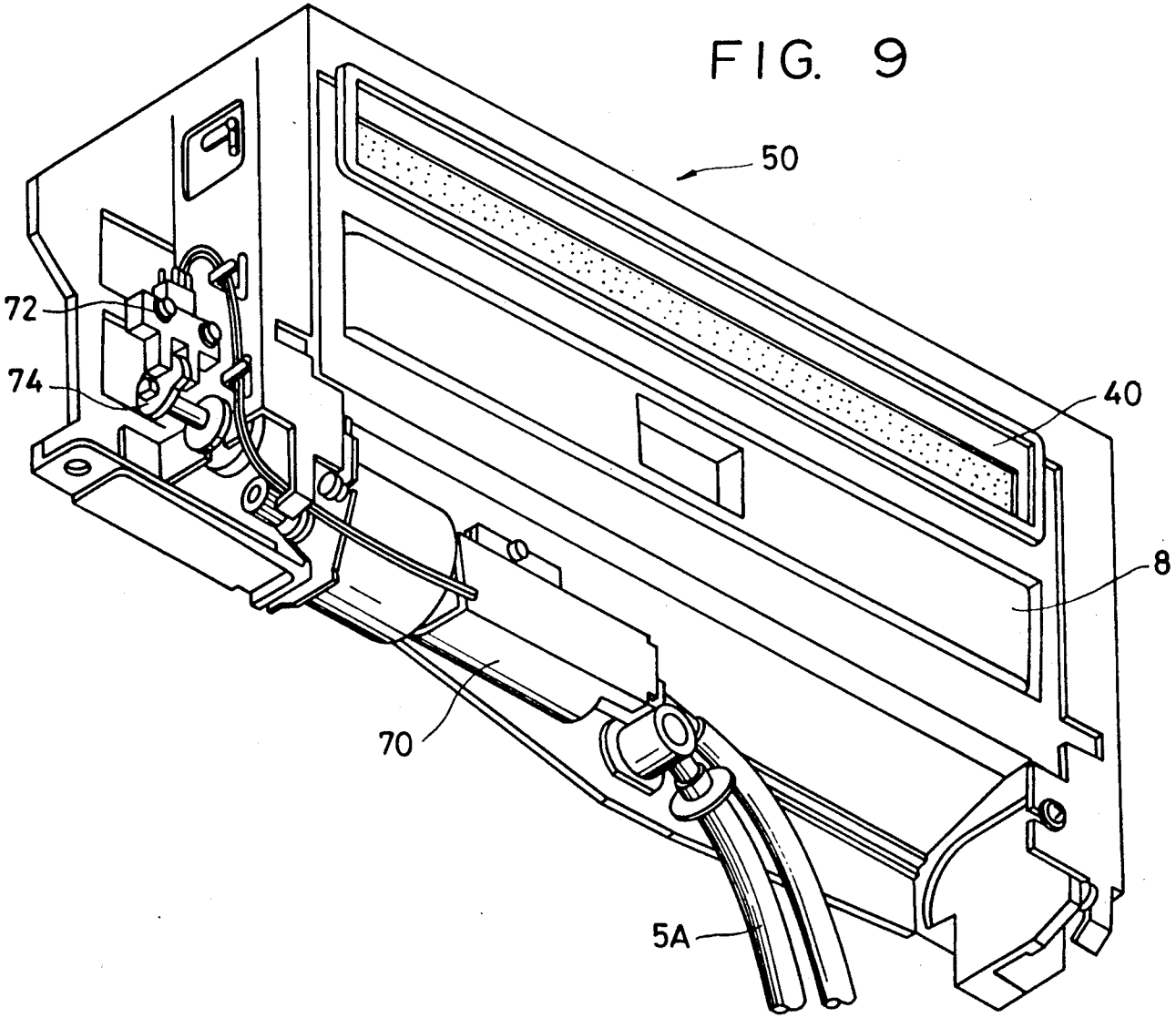
FIG. 9 is a diagrammatic perspective view showing the construction of the cap unit of FIG. 8.

FIG. 9 is a perspective view showing the construction of the cap unit 50. A motor unit 70 moves the partial cap 8 or global cap 40 of the cap unit 50 into and out of contact with the recording head H when the cap unit 50 opposes the recording head H. (The global cap 40 contains a moisture absorbing means so as to protect all the discharging openings from moisture.) A sensor 72 of the photocoupler type is secured to the cap unit 50 so as to detect the positions at which the partial cap 8, hence the global cap 40, is kept in and out of contact with the recording head H. A light shielding plate 74 is arranged to be capable of moving together with the partial cap 8 and the global cap 40. The light shielding plate 74 is arranged to intercept the light path of the sensor 72, thereby causing the sensor 72 to detect whether the partial cap 8 and the global cap 40 have been brought into or out of contact with the recording head H.

Figure 10:
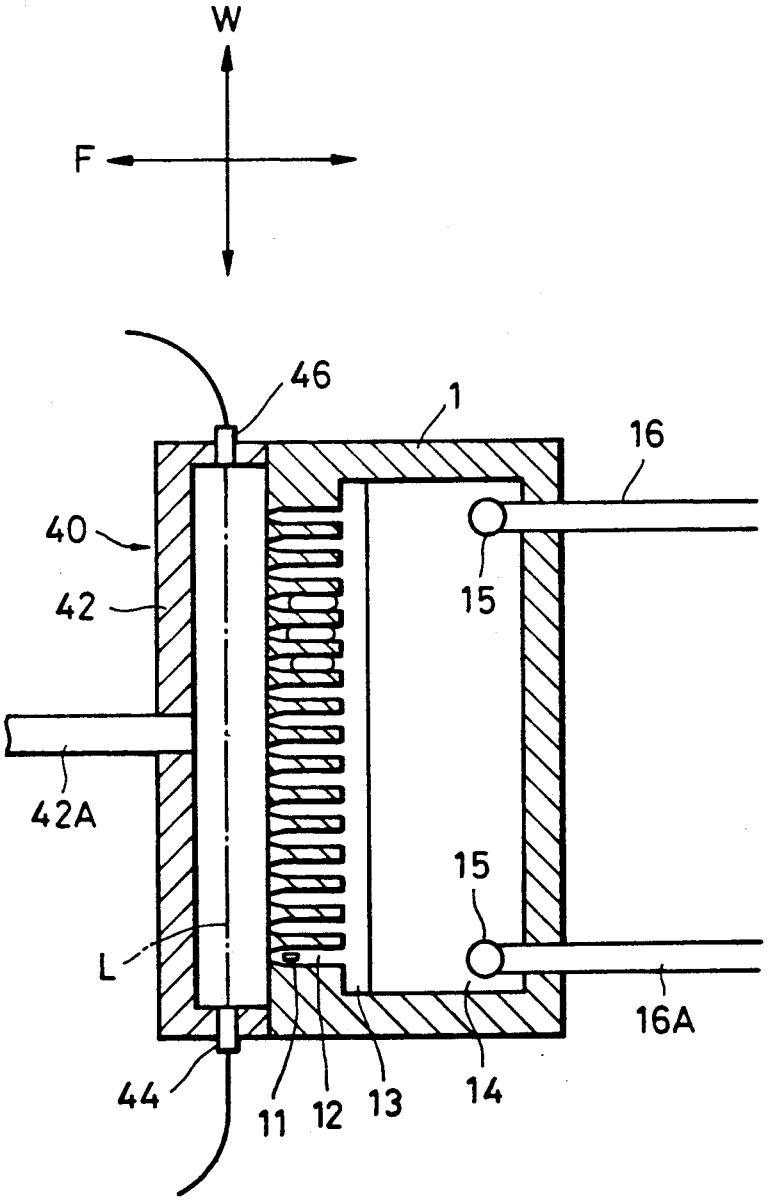
FIG. 10 is a schematic vertical sectional view showing the cap portion of FIG. 9 maintained in contact with the recording head.

FIG. 10 is a schematic cross-sectional view showing the global cap 40 maintained in contact with the discharging element 1. As shown, a cap 42 is arranged to cover the discharging element 1 while keeping the orifices open. A light-emitting device 44 for emitting light such as the laser light of a semiconductor laser or the like is disposed at one side of the global cap 40, while a light-receiving device 46 made from, for example, a phototransistor, is disposed at the other side of the global cap 40. Since the devices 44 and 46 are disposed at the opposite sides of the cap 42, the droplets discharged from the individual orifices can intercept the light path L between the devices 44 and 46. The interior of the cap 42 communicates with the first pressure means through a tube 42A.

After a predetermined amount of information has been recorded or recording has been continued for a predetermined time period, the arrangement shown in FIG. 10 is utilized to detect whether or not a discharge failure has occurred.

Initially, the light-emitting device 44 is driven to emit light toward the light-receiving device 46, and drive pulses of constant frequency are applied to the energy-generating devices in individual liquid channels 12 in the order from an energy-generating device 11 to the uppermost one. (In FIG. 10, the energy-generating device 11 alone is shown and the illustration of the remaining energy generators is omitted for the sake of simplicity.) The discharge openings 12 which are subjected to no discharge failure can discharge ink droplets to intercept the light path L, thereby switching the light-receiving device 46. However, if there is an orifice which communicates with a liquid channel 12 in which a discharge failure has occurred, neither a normal form of ink droplet or even a slight amount of ink can be discharged from such orifice. Consequently, the light-receiving device 46 will be unstably switched or will not switched. In this manner, the discharge failure is detected and, at the same time, data representing the position of the liquid channel 12 which includes the energy generator in question is obtained. This position data is stored in a memory 90C (refer to FIG. 11), which will be described later, so that it can be utilized in the subsequent process of recovery from the discharge failure. This detection operation can be completed within approximately 1.6 seconds when a recording head of the full line type having discharging openings arrayed across a range corresponding to the width of a recording sheet is driven with, for example, a drive frequency of 2 KHz. Accordingly, the amount of ink consumed in the recovery process can be reduced.

Figure 11:
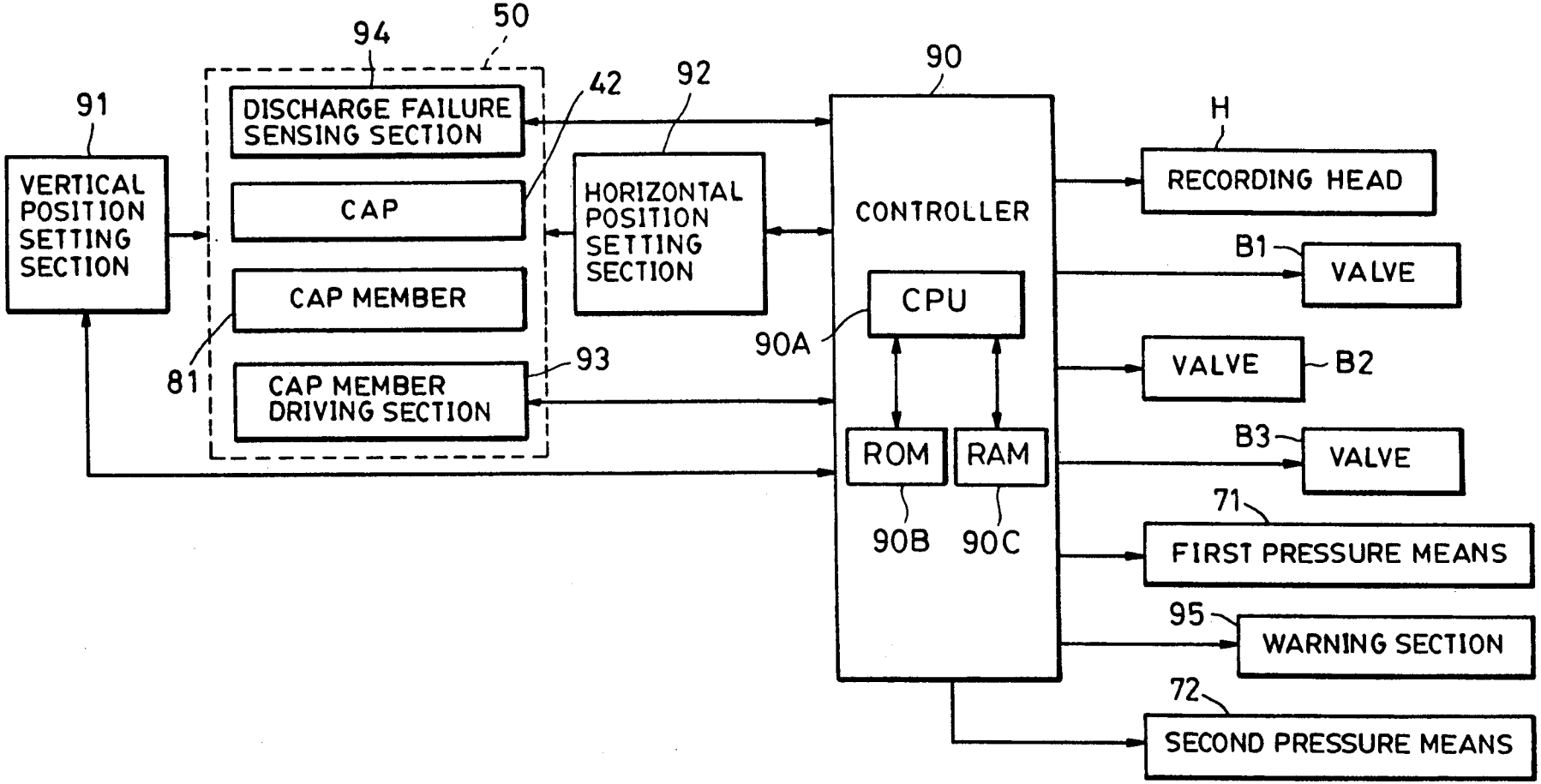
FIG. 11 is a block diagram showing the construction of the control system used in the above embodiment.

FIG. 11 is a block diagram showing the construction of the control system used in the above-described embodiment of the present invention. The illustrated control system includes a controller 90 for providing control over the elements shown. The controller 90 also serves as a control section for controlling the recording process of the entire ink jet recording apparatus. The controller 90 includes a CPU 90A for executing various procedures such as that shown in FIG. 12, a ROM 90B for storing various information such as programs corresponding to the respective procedures executed by the CPU 90A, fixed data and the like, and a working RAM 90C.

A position-setting section 91 sets the cap unit 50 to an upper or lower position thereof. The position-setting section 91 includes elements such as the motor unit 60 and the sensors 110, 120 and 130 which have been explained in connection with the arrangement shown in FIG. 8. Another position-setting section 92 causes the cap portion 82 to move back and forth in the directions indicated by double-headed arrow F of each of FIGS. 7 and 10, that is, between the position at which the cap portion 82 is maintained in contact with the discharging element 1 and the position at which the cap portion 82 is kept away from the discharging element 1. The position-setting section 92 includes elements such as the motor unit 70 and the sensor 72 which 5 have been explained in connection with FIG. 9.

A cap member driving section 93 causes the cap member 81 of the partial cap 8 to move back and forth in the directions indicated by double-headed arrow W of FIG. 7, thereby opposing the cap member 81 to an orifice in which a discharge failure has occurred. The cap member driving section 93 includes elements such as the motor 85 and the photosensor 88 shown in FIG. 7. A sensing section 94 includes the light-emitting device 44 and the light-receiving device 46, which are shown in FIG. 10, and is arranged to detect a discharge failure.

If a discharge failure is not eliminated by performing a predetermined number of cycles of the discharge failure recovery process, a warning section 95 issues a warning to that effect. The warning section 95 may be an indicator, a buzzer or the like.

Figure 12:
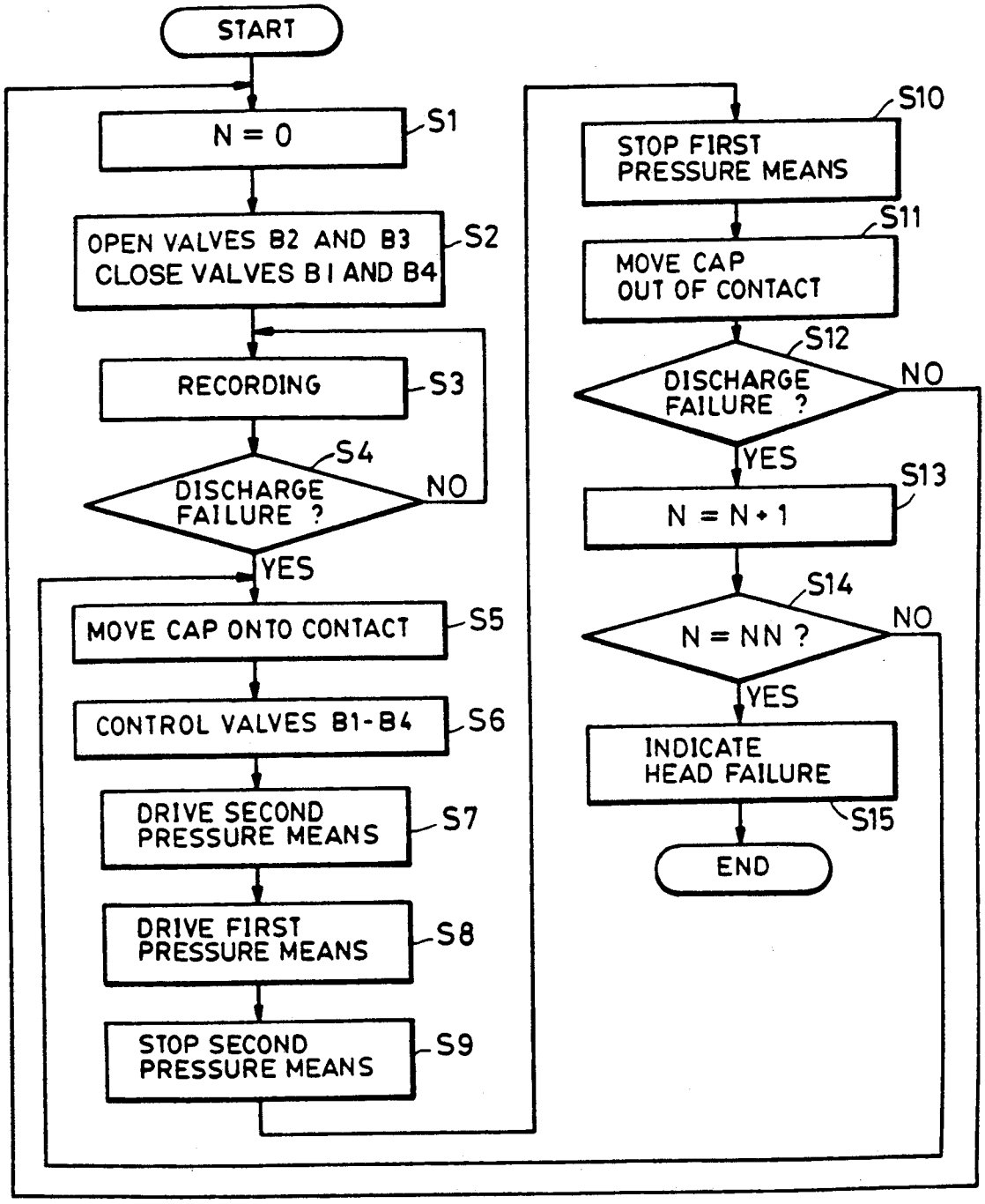
FIG. 12 is a flow chart showing the procedures of a recording process and a discharge failure recovery process.

FIG. 12 is a flow chart showing the procedures of recording and recovery from a discharge failure. Initially, in Step S1, the value of a counter N for counting the number of executions of the recovery process is reset to "0". Then, in Step S2, the valves B2 and B3 are opened, while the valves B1 and B4 are closed. Thus, ink is supplied from the ink tank 6 to the discharging element 1 through the valve B2 owing to a known capillary phenomenon.

In a state wherein the discharging element 1 is charged with the ink, a predetermined amount of information is recorded or recording is continued for a predetermined time period (Step S3). Thereafter, in Step S4, detection is made as to whether or not a discharge failure has occurred. Since this detection has been explained in detail in connection with FIG. 10, a description thereof is omitted. If no discharge failure is detected in Step S4, the process returns to Step S3, while if a discharge failure is detected, the process proceeds to Step S5. In Step S5, the cap portion 82 is positioned in close proximity to an orifice in which the discharge failure has occurred, and the cap member 8 is secured so that the orifice in question is opened with the other orifices closed. Then, in Step S6, the valves B1 and B2 are closed, while the valves B3 and B4 are opened.

In Step S7, the second pressure means 72 is activated to pressurize the liquid and/or the gas present in the liquid channel in question from the direction of the orifice, thereby forcing foreign matter which has caused the discharge failure, for example, dust particles, bubbles or excessively condensed ink, into the common liquid chamber 14. In Step S8, the first pressure means 71 is activated to cause an ink flow within the common liquid chamber 14, thereby expelling the foreign matter with the ink flow from the common liquid chamber 14 through a discharge path 16A. It is preferable that the second pressure means 72 be of a type which can generate a pressure sufficient to positively force the foreign matter such as dust particles into the common liquid chamber 14 against the pressure applied by the first pressure means 71.

In Step S9, after the foreign matter which has caused the discharge failure has been expelled from the common liquid chamber 14, the second pressure means 72 is stopped. However, the first pressure means 71 is maintained in operation until the liquid chamber 14 and the individual liquid channels ar charged with ink. After they have completely charged with the ink, the first pressure means 71 is stopped in Step S10. Then, in Step S11, the cap member 81 is moved in the direction indicated by one head of the arrow F of FIG. 7, that is, in the direction in which the cap member 81 moves away from the discharging element 1. In Step S12, whether a discharge failure has occurred is detected. If the answer is "NO", the process returns to Step S1 and it waits for the next cycle of recording to be started. If the answer is "YES", the process returns to Step S13, where the value of the counter N is incremented by one. Then, in Step S14, it is determined whether the value of the counter N has reached the predetermined number NN of repetitions of recovery operation. If the answer is "NO", the process returns to Step S5, where the discharge-failure recovery operation is repeated. If the answer in Step S14 is "YES" although the predetermined number NN of cycles of the recovery process are repeated, it is determined that a failure has occurred. The process proceeds to Step S15, where an operator is informed of that fact, as by visual indication.

Figure 13:
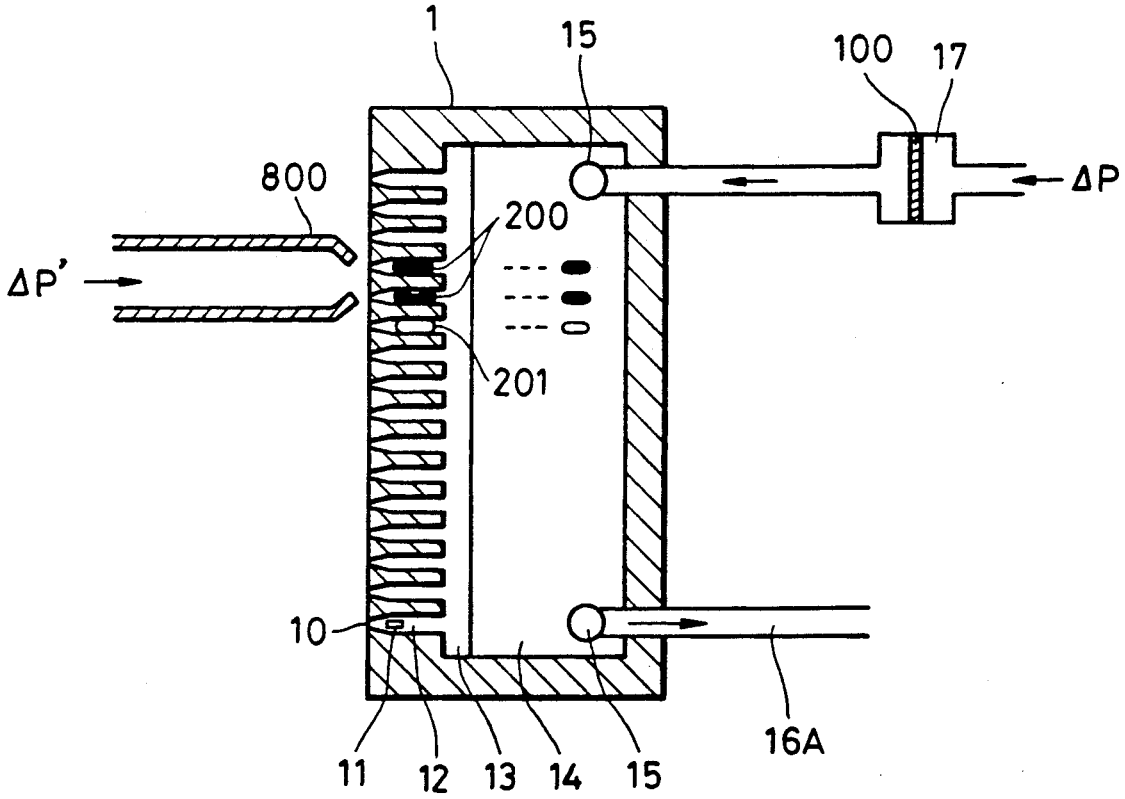
FIG. 13 is a schematic vertical sectional view of another embodiment, and shows the state of a nozzle being maintained in contact with a recording head.

FIG. 13 is a diagrammatic cross-sectional view showing a second embodiment of the present invention. In the second embodiment, a nozzle 800 having a miniature orifice is substituted for the cap member 81 explained in connection with the first embodiment. If a discharge failure occurs in a particular orifice 10 of the recording head, high-pressure gas and/or liquid is sprayed on the orifice 10 through the miniature orifice so that foreign matter which has caused the discharge failure, such as the dust particles 200, the bubble 201 or excessively condensed ink, is forced into the common liquid chamber 14. The foreign matter is then expelled from the common liquid chamber 14 by the first pressure means 71.

As is apparent from the foregoing, in either of the above embodiments, if a discharge failure occurs in a particular discharging opening, gas and/or liquid is forced into the discharging opening to eliminate foreign matter which has caused the discharge failure. Accordingly, a relatively-low-pressure pump may be used as means for supplying the gas and/or the liquid, and the flow rate per liquid channel can be increased. In addition, it is possible to prevent an excessive amount of ink from being consumed. Moreover, either of the above embodiments makes it possible to rapidly detect a problem such as the failure of a recording head.

In either of the above embodiments, foreign matter such as dust particles is eliminated from the orifice in question by applying pressure to the orifice from the exterior thereof. Accordingly, if either of the above arrangements is applied to a discharging element of the type provided with tapered liquid channels, it is possible to likewise effectively eliminate foreign matter such as dust particles.

Needless to say, the present invention can be very effectively and readily applied to recording heads of any type that include a plurality of discharging openings, whether or not the discharging openings are arrayed over a range corresponding to the entire width of a recording medium, whether it is a full line type or a serial type, and no matter how a supply system for ink may be arranged.

Further, the arrangement and the driving method of the partial cap 8 and the global cap 40 are not limited to only those explained in connection with each of the above embodiments.

The method of detecting a discharge failure and the position of an orifice in which the discharge failure has occurred is not limited to the method used in each of the above embodiments. For instance, during normal recording or test recording, an operator may visually detect by visual inspection whether or not a discharge failure has occurred or the position of an orifice which has been subjected to a discharge failure. In this case, it is preferable to provide a switch actuated to start a discharge failure recovery process or a switch actuated to input data on an orifice position where a discharge failure has occurred. Alternatively, after a recording medium is subjected to, for example, test recording, a read sensor or the like may be utilized to read the result of the test recording for the purpose of detecting a failed orifice or the position thereof.

In either of the above embodiments, after one recording process has been completed, a decision is made as to whether or not a discharge failure has occurred and, if necessary, a predetermined discharge failure recovery process is performed. However, the discharge failure recovery process may be performed immediately after the electrical power source of the apparatus has been turned on or before recording is started in a case where the apparatus is out of operation for a long time.

In either of the above embodiments, the first pressure means 71 is provided as the means for causing the ink flow within the ink supply system. The first pressure means 71 may be of any type that can reliably supply ink to the recording head and expel the ink from the common liquid chamber.

Either of the above embodiments is arranged to selectively apply a recovery process to an orifice or orifices in which a discharge failure has occurred. However, it is also possible to adopt an arrangement in which the recovery process is applied to all the orifices, which will include any orifice subjected to a discharge failure.

As is apparent from the foregoing, the present invention makes it possible to realize a recovery process utilizing the external application of pressure to a particular orifice or orifices within an ink jet recording apparatus including a plurality of orifices. Accordingly, it is possible to reliably eliminate foreign matter which causes a discharge failure, whereby the reliability of the recovery process can be remarkably improved. In accordance with either of the above embodiments, since the amount of ink consumed per recovery process can be minimized, the running cost of the apparatus can be reduced to a remarkable extent. In addition, since the pressure means such as a pump may be of a relatively low pressure type, the pressure means can be inexpensively constructed and the degree of freedom of strength design of the ink supply system can be increased.

As described above in detail, the present invention is intended to readily and reliably effect the process of recovery from a discharge failure by concentrating pressure on only the particular opening or openings from among a plurality of discharging openings in order to force gas or liquid from the discharging opening in question into the corresponding liquid channel. In addition, the present invention makes it possible to remarkably improve the effect of the discharge failure recovery process by causing an ink flow in the ink path under the pressure thus applied.

It is to be understood from the foregoing detailed description that the present invention can be embodied in the best preferred form with the embodiments explained with reference to FIGS. 6 through 12.

In the present invention, for example, air or an inert gas may preferably be used as gas to be forced from a discharging opening into the corresponding ink path. Alternatively, a liquid such as ink, a so-called clear ink or, as occasion demands, the solvent of ink may also be utilized. In either case, it is effective to force either gas or liquid, rather than a mixture of gas and liquid, from a discharging opening. Most preferably, air is used since a satisfactory effect can be easily realized.

In the present invention, as an energy-generating source for generating the energy required to discharge ink, a piezoelectric device which is an electro-mechanical converter may be used in place of a heat-generating device which is an electricity-heat converter with a heat-generating resistor and electrodes connected thereto.

In addition, in an ink jet head to which the present invention is applied, the direction in which ink is discharged from a discharging opening and the direction in which ink is supplied to the portion in a liquid channel which contains an energy generator may be substantially the same as each other or may differ from each other (for instance, the axes of the two directions may cross each other at approximately right angles).

The present invention has the following features and advantages in addition to those described above.

The present invention brings about excellent effects particularly in a recording head, recording device of the bubble jet system among the ink jet recording system.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving which gives rapid temperature elevation exceeding nucleate boiling corresponding to the recording information on an electricity-heat converter arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333 and 4,459,600 disclosing the constitution having the heat acting portion arranged in the flexed region is also included in the present invention. In addition, the present invention can also be effectively made of the constitution as disclosed in Japanese Patent Laid-Open Application No. 59-123670 which discloses the constitution using a slit common to a plurality of electricity-heat converters as the discharging portion of the electricity-heat converter or Japanese Patent Laid-Open Application No. 59-138461 which discloses the constitution having the opening for absorbing pressure waves of heat energy corresponding to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording to perform a preliminary mode which performs discharging separate from recording.

Further, as the recording mode of the recording device, the present invention is extremely effective for not only the recording mode using primary stream color such as black, etc., but also a device equipped with at least one of plural different colors or full color by color mixing, whether the recording head is either integrally constituted or combined in plural number.

While the present invention has been described with respect to what is presently considered to be preferred embodiments, it is to be understood that the invention is not limited to the disclosed embodiments. To the contrary, the present invention includes all modifications and arrangements within the scope of the appended claims.

What is claimed is:

1. An ink jet apparatus comprising:

an ink jet head including a plurality of discharging openings for discharging ink and an ink path communicating with said discharging openings, said ink path comprising a plurality of liquid channels communicating with respective said discharge openings and a common liquid chamber communicating with said plurality of liquid channels, wherein each said liquid channel includes an energy generator for generating energy to discharge ink;

partial cap means for covering at least one particular discharging opening from among said plurality of discharging openings;

pressure means associated with said partial cap means for supplying sufficient pressure through said particular discharging opening and into said respective liquid channel to force any foreign matter in said liquid channel into said common liquid chamber; and means for causing an ink flow within said common liquid chamber to expel therefrom any foreign matter forced into said common liquid chamber by said pressure means.

2. An ink jet apparatus according to claim 1, wherein each said energy generator is an electro-thermal converter comprising a heat-generating resistor and an electrode connected thereto to generate heat energy to discharge ink.

3. An ink jet apparatus according to claim 1, wherein each said energy generator is a piezoelectric device.

4. An ink jet apparatus according to claim 1, wherein the direction in which ink is discharged from each of said discharging openings is substantially the same as the direction in which ink is supplied to the portion in each of said liquid channels in which said energy generator is disposed.

5. An ink jet apparatus according to claim 1, wherein the direction in which ink is discharged from each of said discharging openings differs from the direction in which ink is supplied to the portion in each of said liquid channels in which said energy generator is disposed.

6. An ink jet apparatus according to claim 5, wherein the two direction are at approximate right angles to each other.

7. An ink jet apparatus according to claim 1, wherein said ink jet head is of a full line type in which said plurality of discharging openings are arranged side by side over a range corresponding to the width of a recording medium.

8. An ink jet apparatus according to claim 1, wherein said partial cap means is a belt-shaped member for keeping open said particular discharging openings while keeping closed the remaining discharging openings.

9. An ink jet apparatus according to claim 1 further including a global cap for covering all said discharging openings.

10. An ink jet apparatus according to claim 9, wherein said global cap includes sensing means for sensing the state of ink discharged from said discharging openings.

11. An ink jet apparatus according to claim 10, wherein said sensing means is a photocoupler.

12. An ink jet apparatus according to claim 1, wherein said pressure means is a pump.

13. An ink jet apparatus according to claim 1, wherein said ink jet head includes a supply path connected to one end of said common liquid chamber and a discharge path connected to the other end of said common liquid chamber, said supply and discharge paths cooperating with each other to form the ink flow within said common liquid chamber during a recovery operation.

14. An ink jet apparatus according to claim 6, wherein said supply path is provided with a filter.

15. An ink jet apparatus according to claim 13, further including a waste ink reservoir which communicates with said discharge path.

16. An ink jet apparatus according to claim 1, wherein said pressure means creates said pressure by forcing a gas through said particular discharging opening.

17. An ink jet apparatus according to claim 1, wherein said pressure means creates said pressure by a liquid through said particular discharging opening.

18. A recovery unit comprising:

partial cap means for covering at least one particular discharging opening from among a plurality of discharging openings formed in an ink jet head having a plurality of liquid channels communicating with respective said discharging openings and a common liquid chamber communicating with said plurality of liquid channels; and pressure means associated with said partial cap means for supplying sufficient pressure through said particular discharging opening and into said respective liquid channel to force any foreign matter in said liquid channel into said common liquid chamber; and means for causing an ink flow within said common liquid chamber to expel therefrom any foreign matter forced into said common liquid chamber by said pressure means.

19. A recovery unit according to claim 18, wherein said partial cap means is a belt-shaped member for keeping open said particular discharging opening while keeping closed the remaining discharging openings.

20. A recovery unit according to claim 18, further including a global cap for covering all of said discharging openings.

21. A recovery unit according to claim 20, wherein said global cap includes sensing means for sensing the state of ink discharged from said discharging openings.

22. A recovery unit according to claim 21, wherein said sensing means is a photocoupler.

23. A recovery unit according to claim 18, wherein said pressure means is a pump.

24. A cap unit according to claim 18, wherein said pressure means creates said pressure by forcing a gas through said particular discharging opening.

25. A recovery unit according to claim 18, wherein said pressure means creates said pressure by forcing a liquid through said particular discharging opening.

26. A recovery method comprising the steps of:

providing an ink jet head including a plurality of discharging openings for discharging ink and an ink path communicating with said discharging openings, said ink path comprising a plurality of liquid channels communicating with respective said discharge openings and a common liquid chamber communicating with said plurality of liquid channels;

sensing the state of ink being discharged from a plurality of discharging openings formed in said ink jet head;

causing partial cap means to cover particular discharging openings which include a discharging opening in which a discharge failure has been detected from among said plurality of discharging openings; and supplying sufficient pressure through said particular discharging openings and into said respective liquid channels by means of said partial cap means to force any foreign matter in said liquid channels into said common liquid chamber; and causing an ink flow within said common liquid chamber to expel therefrom any foreign matter forced into said common liquid chamber by said pressure supplying step.

27. A recovery method according to claim 26, wherein said ink flow is caused during said pressure supplying step.

28. A recovery method according to claim 26, further including a warning step after said pressure supplying step, said warning step including executing a sensing operation and issuing a warning on the basis of the result of said sensing operation.

* * * * *

UNITED STATES PATENT AND TRADEMARK OFFICE

CERTIFICATE OF CORRECTION

PATENT NO. : 5,128,690

DATED : July 7, 1992

INVENTOR(S) : MINORU NOZAWA

It is certified that error appears in the above-identified patent and that said Letters Patent is hereby corrected as shown below:

COLUMN 1

Line 58, "31" should read --B1--.

COLUMN 2

Line 51, "∴q=Δp/{r1+n(RH+RC+RF+RS)}" should read --∴q=Δp/{R1+n(RH+RC+RF+RS)}--.
Line 63, "R1>RH+RC+RF+RS" should read --R1>>RH+RC+RF+RS--.

COLUMN 3

Line 37, "high-pressure proof" should read --high-pressure-proof--.

COLUMN 5

Line 30, "corresponding liquid" should read --corresponding orifice through the gas and/or the liquid present in the liquid--.
Line 55, "gears 86" should read --gear 86--.

COLUMN 7

Line 16, "switched." should read --be switched.--.
Line 56, "5" should be deleted.

COLUMN 8

Line 52, "ar" should read --are--.

--

UNITED STATES PATENT AND TRADEMARK OFFICE

CERTIFICATE OF CORRECTION

PATENT NO. : 5,128,690

DATED : July 7, 1992

INVENTOR(S) : MINORU NOZAWA

It is certified that error appears in the above-identified patent and that said Letters Patent is hereby corrected as shown below:

COLUMN 12

Line 27, "primary" should read --a primary--.

COLUMN 13

Line 15, "direction" should read --directions--.
Line 26, "claim 1" should read --claim 1,--.
Line 46, "claim 6," should read --claim 13,--.
Line 56, "by a" should read --by forcing a--.

COLUMN 14

Line 25, "cap unit" should read --recovery unit--.
Line 37, "discharge" should read --discharging--.

Signed and Sealed this

Twelfth Day of October, 1993

Bruce Lehman

*Attest:*

BRUCE LEHMAN

*Attesting Officer*

*Commissioner of Patents and Trademarks*

--